US010247195B2

(12) United States Patent
Manninen et al.

(10) Patent No.: US 10,247,195 B2
(45) Date of Patent: Apr. 2, 2019

(54) IMPELLER FOR A CENTRIFUGAL HEADBOX FEED PUMP

(71) Applicant: Sulzer Management AG, Winterthur (CH)

(72) Inventors: Heikki Manninen, Mänttä (FI); Reijo Vesala, Kotka (FI)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 15/561,742

(22) PCT Filed: Dec. 29, 2015

(86) PCT No.: PCT/EP2015/081357
§ 371 (c)(1),
(2) Date: Sep. 26, 2017

(87) PCT Pub. No.: WO2016/165795
PCT Pub. Date: Oct. 20, 2016

(65) Prior Publication Data

US 2018/0112673 A1 Apr. 26, 2018

(30) Foreign Application Priority Data

Apr. 15, 2015 (EP) ..... 15163713

(51) Int. Cl.
*F04D 29/24* (2006.01)
*F04D 29/22* (2006.01)
(Continued)

(52) U.S. Cl.
CPC ..... *F04D 29/24* (2013.01); *F04D 1/00* (2013.01); *F04D 7/04* (2013.01); *F04D 29/22* (2013.01);
(Continued)

(58) Field of Classification Search
CPC ... F04D 29/24; F04D 1/00; F04D 7/04; F04D 29/22; F04D 29/2261; F04D 29/445;
(Continued)

(56) References Cited

U.S. PATENT DOCUMENTS 3,644,056 A * 2/1972 Wiselius ..... F04D 29/2277 415/143
5,019,136 A * 5/1991 Elonen ..... F04D 9/003 366/157.1
(Continued)

FOREIGN PATENT DOCUMENTS

CA 2895715 A1 6/2014
EP 0515466 B1 8/1995
(Continued)

OTHER PUBLICATIONS

International Search Report dated Mar. 18, 2016 in corresponding International Application No. PCT/EP2015/081357, filed Dec. 29, 2015.
(Continued)

*Primary Examiner* — Carlos A Rivera
*Assistant Examiner* — Eric J Zamora Alvarez
(74) *Attorney, Agent, or Firm* — Global IP Counselors, LLP

(57) ABSTRACT

An impeller structure for a centrifugal pump that can feed both fibrous suspensions and water into a headbox of a fibrous web machine. The centrifugal pump utilizing the impeller structure pumps stock for both liquid-laid and foam-laid paper, tissue or board making applications and pumps water or other dilution fluid into a headbox circulation. In general, the impeller of the present invention is especially suitable for all such pumping tasks in the production of fibrous webs that a pulseless or low-pulse impeller is needed.

15 Claims, 4 Drawing Sheets

(51) Int. Cl.
*F04D 1/00* (2006.01)
*F04D 7/04* (2006.01)
*F04D 29/44* (2006.01)

(52) U.S. Cl.
CPC ..... *F04D 29/2261* (2013.01); *F04D 29/445* (2013.01)

(58) Field of Classification Search
CPC ..... F04D 29/2216; F04D 29/2222; F04D 29/242; F05D 2240/30; F05D 2260/15
See application file for complete search history.

(56) References Cited

U.S. PATENT DOCUMENTS 5,167,678 A * 12/1992 Elonen ..... F04D 9/003 415/169.1
6,666,660 B2 * 12/2003 Kegg ..... F04D 29/281 15/326
6,893,207 B2 * 5/2005 Kao ..... F04D 29/2288 415/58.2
7,179,050 B2 * 2/2007 Hopfensperger ..... F04D 29/281 415/204
7,597,541 B2 * 10/2009 White ..... F04D 29/282 415/204
8,074,647 B2 * 12/2011 Truitt ..... A61M 16/022 128/200.24
2009/0155048 A1 6/2009 Sensel et al.
2010/0061841 A1 3/2010 Visintainer et al.
2010/0061849 A1 * 3/2010 Visintainer ..... F04D 7/04 415/206
2010/0135765 A1 * 6/2010 Burgess ..... F04D 7/04 415/1
2011/0194931 A1 8/2011 Swiatek et al.
2011/0318204 A1 12/2011 Omori
2014/0030055 A1 * 1/2014 Jayaram ..... F04D 1/00 415/1

FOREIGN PATENT DOCUMENTS

GB 1468029 A 3/1977
GB 2337795 A 12/1999
RU 2511967 C1 4/2014
SU 1731999 A1 5/1992
WO 2015000677 A1 1/2015

OTHER PUBLICATIONS

Extended European Search Report dated Sep. 25, 2015 in corresponding European Patent Application No. 15163713.9, filed Apr. 15, 2015.
International Preliminary Report on Patentability dated Aug. 2, 2017 in corresponding International Patent Application No. PCT/EP2015/081357, filed Dec. 29, 2015.

* cited by examiner

IMPELLER FOR A CENTRIFUGAL HEADBOX FEED PUMP

CROSS-REFERENCE TO RELATED APPLICATIONS

This application is a U.S. National Stage application of International Application No. PCT/EP2015/081357, filed Dec. 29, 2015, which claims priority to European Patent Application No. 15163713.9, filed Apr. 15, 2015 the contents of each of which are hereby incorporated herein by reference.

BACKGROUND

Field of Invention

The present invention relates to an impeller for a centrifugal pump. The present invention relates especially to a novel impeller structure for a centrifugal pump used for feeding both fibrous suspensions and water into a headbox of a fibrous web machine. The centrifugal pump utilizing the impeller of the present invention is, for instance, suitable for pumping fibrous suspensions, i.e. stock for liquid-laid paper, tissue or board making applications and for pumping water or other dilution fluid into the headbox circulation. In general, the impeller of the present invention is especially suitable for all such pumping tasks in the production of fibrous webs that a pulseless or low-pulse impeller is needed. The impeller of the present invention may, in its specific construction, be used to pump also foam-based fibrous web making suspensions or mere foam in foam-laid fibrous web making applications.

Background Information

The production of paper, tissue and board has been based on the use of liquid-laid suspensions for more than a century. In other words, the paper, tissue or board making fibres have been suspended in water as a very dilute suspension, which is introduced on the wire or between the wires of the fibrous web machine via at least one so-called headbox. The at least one headbox receives the suspension from a centrifugal feed pump, a so called headbox feed pump. The present day fibrous web machines set high demands for the headbox feed pump.

From the early times of papermaking the production rates of fibrous web machines have continuously increased such that the volume flows of the dilute suspensions introduced to fibrous web machines are now enormous. Since it has been customary practice that only one feed pump may be used for pumping the entire amount of suspension needed for the paper or board manufacture in one fibrous web machine, the size of the headbox feed pumps have grown. This has been the main reason why, in practice, all headbox feed pumps are now so called double-suction pumps.

Additionally, the ever-increasing demands for higher quality of the end product set high requirements for the pulse levels of the headbox feed pumps. Here, in this application, the term 'headbox feed pump' is understood to cover all such pumps in fibrous web production that feed any kind of fluid, fibrous or fibreless, into the headbox or between the headboxes of the fibrous web machine or to some other such position that the pulses originating from the pump may have an adverse effect in the quality of the fibrous web product. It is a known fact that centrifugal pumps, due to their type of operation, create pressure pulses in the fluid they are pumping. The known pulses are, on the one hand, created at the point where the fluid that is rotating along with the impeller in the pump volute casing departs from the volute casing to the pressure outlet duct of the pump. A so-called cutwater is a kind of a tongue that physically cuts a part of the rotating fluid to the outlet duct of the pump. A pressure pulse is created each time an impeller working vane passes the cutwater tongue. The same may also be expressed by the cutwater tongue blocking the flow from a vane passage (open flow passage between subsequent working vanes) to the volute. Thus, the pulse frequency (f) may be calculated by using the formula $f=z*n/60$, where z is the number of impeller working vanes and n is the rotational speed of the impeller in rpm. For instance, if the number of working vanes is 6 and the rotational speed 1200 rpm, the pulse frequency f=120 Hz, or a multitude thereof. On the other hand, it is also a known pulse creation mechanism that when the impeller of a centrifugal pump is running the pressure pulses relate to non-symmetricity of the impeller, whereby such a pulse is notable at a frequency $f=n/60$, or a multitude thereof.

A few ways to fight the pulsation tendency of a centrifugal pump are known in the prior art. A first, and simple way is to increase the distance between the cutwater tongue and the impeller working vane. However, as the efficiency ratio is inversely proportional to the distance, the distance is, in practice, nowadays, rather reduced than increased.

Another way was to increase the number of impeller working vanes, since the higher the number of impeller working vanes, the lower the pulse amplitude and the higher the pulse frequency. Again, practical reasons prevent increasing of the number of working vanes too high as the efficiency ratio will be compromised due to reducing open cross-sectional flow area and increasing friction in the vane passages.

A yet further way of lowering the pulsation is inclining the outer or trailing edges of the impeller working vanes in relation to the cutwater tongue. It is easy to understand, as an example, that if both the cutwater tongue and the outer edges of the impeller working vanes are edges that extend in the direction of the impeller or pump axis, the pressure pulse, when a working vane passes the cutwater tongue, is as high as it can be, as the two edges pass each other simultaneously for the full length thereof at a close distance. The same applies to all such constructions that the edge of the cutwater tongue and the trailing edge of the working vane parallel. To prevent this abrupt pulse creation mechanism it has been suggested that the impeller working vanes and/or the cutwater tongue are inclined in relation to axial direction or at least to one another such that the above mentioned edges facing each other are not parallel. As soon as the direction of the outer edge of the impeller working vane differs from that of the cutwater tongue, the length (duration) of the pulse is increased and the magnitude of the pulse is lowered. In other words, the fluid flow from the vane passage to the volute is not blocked suddenly, but it is first, in a way, throttled in a narrowing flow path between the working vane and the cutwater tongue. Thus, it has been suggested, for instance in EP-B1-0515466, to increase and incline the number of impeller working vanes and the working vanes such that there is always one working vane facing the cutwater tongue, whereby there would be, in practice, a continuous pulse at the cutwater tongue.

Practice has shown that in headbox feed applications two types of centrifugal pumps applying the above described principles of constructing an impeller are mainly used. Most often, the headbox feed pumps are of a so called double suction structure, i.e. the impeller of the pump having a single shroud with two sets of identical working vanes on both sides of the shroud, and a casing provided with two identical suction inlets on the opposite axial sides of the impeller and a single pressure outlet for delivering the suspension to the headbox. The impeller has been designed such that the working vanes on one side of the impeller shroud are not opposite the working vanes on the other side of the impeller shroud but exactly in between them, i.e. the working vanes are staggered. Thereby, in a way, the pulse frequency at the circumference of the impeller is doubled. Another way of thinking is that both sides of the impeller shroud create their own series of pulse waves, and since the working vanes of the opposite sides of the shroud are staggered, the peaks of pulse waves created by the working vanes on one side of the shroud meet in the outlet duct with the valleys of the pulse waves created by the vanes on the opposite side of the shroud, whereby the pulse waves dampen one another. The result is, depending on the shape of the pulse waves, pulseless or in the least a low-pulse flow. In view of the pressure pulses the double-suction pump is good, as the pulses (peak-to-peak pulses, i.e. pulses measured from the valley to the peak of a pressure wave) are normally of the order of less than 1000 Pa in ordinary headbox feed applications at the critical frequencies, i.e. $f_{i1}$=frequency of the impeller=n/60, $f_{i2}$=2*n/60, $f_1$=frequency of the working vanes=z*n/60 and $f_2$=2*z*n/60. The total number of working vanes in headbox feed pumps is typically 12-14. The frequency range the paper or board machine manufacturers consider as critical is 0-100 Hz, sometimes up to 200 Hz.

However, the double suction pump has a complicated construction, as both the impeller and the casing of the pump are difficult, and costly, to manufacture. When in use the double suction pumps have substantially poor efficiency ratios (of the order of 91%), at least when compared to pumps using end suction or single suction impellers. The reasons for the reduction of the efficiency ratio relate to the complicated suction inlet construction, and the inclination of the working vanes, meaning increased surface area (friction) and narrower flow passages. An additional downside in double suction pumps, especially at lower production rates (partial load), is the tendency of the pump to start switching the flow from one side of the impeller shroud to the opposite side thereof and back (cf. von Karman vortex), which means, in practice, that only one of the impeller sides is working at a time. This means that the number of working vanes communicating efficiently with the cutwater tongue is halved, whereby the pulse frequency is also halved so that the pulses the impeller creates may easily come to the critical range. As to the partial load, it is a fact with modern fibrous web machines that their headbox feed pumps are chosen in view of the maximum thickness or basis weight of the end product, whereby the pumps are running almost always at partial load as the fibrous web producers are seldom producing continuously any product, not to mention the heaviest possible one.

A better option in view of both the costs of manufacture and the efficiency ratio is an end suction or a single-suction centrifugal pump, which is closer to an ordinary centrifugal pump of its construction. However, to be able to provide the impeller with a sufficient number of working vanes, for increasing the pulse frequency for instance, without adding the working vanes on a single face of the impeller shroud (which would reduce the cross-sectional open area of the vane passages, and, as a result, the efficiency ratio, significantly), the impeller includes a partition wall as is disclosed in GB-1468029. The partition wall is arranged between the shroud and the front edges of the impeller working vanes such that the working vanes are divided in the flow direction of the fluid to be pumped into two substantially equally wide working vanes. However, to increase the pulse frequency the working vanes on opposite sides of the partition wall are circumferentially staggered, i.e. have been positioned in exactly the same manner as described above in connection with double suction impellers, i.e. the working vanes on one side of the partition wall are exactly in between the working vanes, i.e. in the middle of each vane passage, on the opposite side of the partition wall. Additionally, the working vanes may be inclined as discussed above to lengthen the duration of the pressure pulse. In view of the pressure pulses the end suction pump with a partitioned impeller is only adequate, as the pulses (peak-to-peak pulses, i.e. pulses measured from the valley to the peak of a pressure wave) are normally of the order of less than 2000 Pa in ordinary headbox feed applications at the critical frequencies, i.e. $f_i$=frequency of the impeller=n/60, $f_{i2}$=2*n/60, $f_1$=frequency of the working vanes=z*n/60 and $f_2$=2*z*n/60. The number of working vanes is typically 12-14 and the critical frequency range 0-200 Hz. In other words, the end suction pump with a partitioned impeller is able to reach the pulse requirement of less than 2000 Pa set for headbox feed pumps by the fibrous web machine manufacturers.

The substantially high pulse value of a single suction partitioned impeller pump of 2000 Pa is caused by the fact that in partial load (discussed already above in connection with double suction pumps), the impeller half located between the shroud and the partition wall takes care of the pumping and the other half forms a recirculation passage. The recirculation is the utmost indication of the nature of the operation of the partitioned impeller. It is a fact that the partitioned impeller may be designed to work optimally in a single operating point (volume flow and head), when the flows via both sides of the partition wall may be said to be in balance. In every other operating point the flows are more or less out of balance. Accordingly, at least the amplitude of the pulse or pressure waves created by the working vanes on one side of the partition wall are not equal with those created by the working vanes on the opposite side of the partition wall, whereby the flow in the outlet or pressure duct of the pump has pressure pulses higher than those in the optimal operating point. And, naturally, the farther from the optimal operating point the impeller or pump is driven, the higher is the pulsation in the pressure or outlet duct. As to the efficiency ratio of the single end suction pump with partitioned impeller it is somewhat better than that of double suction pumps, but still the inclination of the working vanes, meaning increased surface area (friction) and narrower flow passages, reduces the efficiency. As to the manufacture of the pump, the casing of the end suction pump is clearly easier and cheaper to manufacture than that of the double suction pumps. However, the added partition wall makes the construction of the impeller complicated and costly to manufacture.

In other words, the prior art has, for pumps applied at positions where pressure pulsations are considered problematic, a few suggestions. Firstly, the number of impeller working vanes should be increased either by positioning shorter intermediate working vanes between longer ones on the impeller shroud or by partitioning the impeller by means of its shroud (including both the shroud of the double suction pump and the partition wall of the single suction impeller) to two partitions having first working vanes on one face thereof and second working vanes on the other face thereof, the second working vanes being positioned in staggered fashion in relation to the first working vanes. Secondly, the working vanes should be inclined, i.e. the longitudinal centerline plane of the working vane forming a sharp angle with the front face of the impeller shroud in a plane at right angles to the longitudinal vane axis, for increasing the duration of the pressure pulse created by the working vane when passing the cutwater tongue. In practice, in all headbox feed pumps both suggestions have been taken into use to make sure that the pulse level is low enough at the critical frequencies.

SUMMARY

However, when the prior art impellers were studied in more detail, it was learned that there is still one more source of pulsation that has not been understood and thus not been taken into account when designing the prior art impellers. This source of pulsation is the leading edge of the shorter or intermediate working vanes, which have been traditionally designed such that the leading edge is substantially perpendicular to the flow entering the leading edge area or to the shroud of the impeller. The shorter intermediate vanes are needed to increase the number of vanes without throttling the vane passages too much, i.e. for increasing the pulse frequency. The mechanism of the pulse creation at the leading edge of the shorter intermediate working vanes is such that when the liquid to be pumped flowing in the vane passage between the longer working vanes meets the intermediate working vane and is divided into smaller vane passages between the longer and shorter working vanes, the cross-section of the cavity between the adjacent longer working vanes reduces suddenly, and a pulse wave is born. The pulse wave proceeds to the outer circumference of the impeller and ends up in the pressure outlet duct of the pump.

Thus a main goal of the present invention is to find a means for taking into account the newly found pulsation source in the design of an impeller for a centrifugal pump.

A further additional challenge the manufacturers of fibrous webs sometimes set for the equipment producers to solve is their desire to be able to use both liquid-laid and foam-laid web-making stocks in their process. By foam-laid web-making stock is understood a stock, where the fibres, and other fibrous web making solids are suspended in foam. Such a foamy fibrous suspension or stock may be produced, for instance, by adding into a so called foam pulper water, fibres and surface active agents, surfactants, and agitating the mixture such that a foam is formed. Thus, the fibrous web manufacturers want to be able to choose, depending on the end product, which one of the two web-making processes to use, whereby the equipment in the entire fibrous web making production sequence should be designed to work efficiently and in a problem-free manner with both water-based and foam-based suspensions. One of the most important pieces of equipment are the headbox feed pumps that should be adapted not only to the challenges in pumping ordinary dilute aqueous suspensions with very low pressure pulses but also to the requirements a foam-based suspension sets to centrifugal pumps.

A feature of foam-based suspension or stock that differentiates clearly from water-based suspensions or stocks is the natural separation of air, or more generally, gas from the foam when pumping the foam. Another feature of foam-based suspension or stock that has to be taken into account is the tendency of foam to pulsate when pumped with centrifugal pumps. The tendency is, in a way, far more severe than when pumping liquid based stocks due to generation of noise and heavy vibration, which might, at worst, cause cracks in the flow piping. Traditionally, the noise and vibration has been fought by running the pumps at relatively slow speeds.

The centrifugal pumps used traditionally for pumping liquid-laid fibrous web making stock has had no need to consider air being present in the stock, as in paper making applications the approach flow system of a paper machine is normally provided with a deculator that is specifically designed for separating gas from fibrous suspensions so that air in the stock would not reduce the quality of the end product. In paper or board machines used for producing some less demanding end products there has been no deculator in the approach flow system, but still the low consistency of the stock has ensured that the gas content of the stock has not been even close to causing problems in pumping. Therefore, traditional headbox feed pumps have never been provided with any means for managing gas in the stock.

Thus a secondary goal of the present invention is to find a means for taking into account the need for gas separation in the design of an impeller for a centrifugal headbox feed pump.

A still further desire of the fibrous web manufacturers is that the equipment used in the short circulation of the fibrous web machine could be positioned on the same horizontal level or with as small vertical level differences as possible. This may be especially seen in the positioning of the deculator, which is a huge tank used for separating air from the stock. Nowadays it is located one or two stories higher than the paper machine, as the available suction capability (NPSH=net positive suction head) of traditional headbox feed pumps is relatively low, i.e. the required suction head of traditional headbox feed pumps is relatively high.

Thus, in view of all the above discussion, the headbox feed pump of the future has to be able to fulfil requirements of both water-laid and foam-laid fibrous web making processes, i.e. low pulsation at least at critical frequencies in water-laid and foam-laid fibrous web making processes, capability of separating gas from the stock to be pumped in foam-laid fibrous web making process, capability to be run at higher speeds than earlier to reduce the size of pumps needed for pumping the stock to a fibrous web machine, especially in foam laid fibrous web making processes, lower required suction head, lower energy consumption, lower cost, and more flexibility in the installation.

When considering the above requirements, it is soon observed that traditional headbox feed pumps with partitioned impellers hardly come into question when constructing a novel headbox feed pump that has, among other things, to have a higher efficiency ratio and lower manufacturing costs than the prior art headbox feed pumps, and sometimes even to be provided with means for separating gas from the stock. The sole reason is that the manufacture of double-suction pumps or single-suction pumps having a partitioned impeller cannot be optimized any more in such a manner that the efficiency ratio would be raised while the costs of manufacture would get lower. Furthermore, the additional requirement that the pump should be sometimes provided with gas separation results in that the construction of such pumps would get even more complicated. The impellers of such pumps should be provided with gas separation openings, the openings should be arranged into communication with gas flow paths in the pump casing, and the flow paths should possibly be arranged into communication with the pump shaft provided with gas removal passages. Such arrangements would raise the price of a headbox feed pump of otherwise traditional construction to a significantly higher level.

Thus, an object of the present invention is to design a novel construction for an impeller so that the pulsation of stock, or more generally fluid, in headbox feed applications is reduced.

Another object of the present invention is to design a novel impeller in the construction of which the pulsation created by the leading edge of shorter or intermediate working vanes has been taken into account.

Yet another object of the present invention is to design an impeller for a centrifugal headbox feed pump capable of pumping not only liquid-based but also foam-based suspensions or stocks.

A further object of the present invention is to design a novel impeller capable of separating gas from the stock to be pumped.

A still further object of the present invention is to design a novel impeller for headbox feed applications having a lower required NPSH than prior art headbox feed pumps.

A yet further object of the present invention is to design a novel impeller for headbox feed applications having a better efficiency ratio and lower energy consumption than prior art headbox feed pumps.

In other words, it has been discussed above that the primary goal of the present invention is to introduce a novel construction for an impeller for a single suction headbox feed pump for use in pumping liquid-based suspensions or stocks. However, as a secondary goal of the invention, it has been taken into account in the design of the novel impeller that the impeller may be further provided with means for separating gas from the suspension to be pumped so that the pump provided with the "updated" impeller may be used for pumping both foam-based and liquid-based suspensions.

At least one of the above objects of the present invention, among others, are fulfilled by an impeller for a centrifugal headbox feed pump, the impeller having a shroud with a front face and a circumference, a plurality of long working vanes on the front face, and a plurality of shorter intermediate working vanes on the front face between the long working vanes, the shorter working vanes having a leading edge and a foot part thereof, wherein the shorter intermediate working vanes have a foot length Lfs and an edge length Les, the foot length of the shorter intermediate working vane being Lfs=1.2*Les–3*Les.

Other characterizing features of the impeller of the present invention become evident in the description of the embodiments of the present invention.

The impeller for a centrifugal headbox feed pump of the present invention has several advantages in comparison with prior art centrifugal pumps. At least the following advantages may be found: the same pump capable on pumping both water-based and foam-based fibrous web making stocks, low pulse level, high efficiency ratio, simple construction, easy to manufacture, easy to provide with (non-spinning) means for preventing collection of fibres at the leading and trailing edges of the working vanes and at the possible balance and/or gas separation openings, low-priced headbox feed pump, capability of separating free gas from the foam-based suspensions or stocks, higher suction capability (lower required NPSH), possibility to position the deculator and other equipment of the short circulation to a lower level, lower production costs, and more flexibility in installation.

BRIEF DESCRIPTION OF THE DRAWINGS

Referring now to the attached drawings which form a part of this original disclosure.

DETAILED DESCRIPTION OF THE EMBODIMENTS

Figure 1:
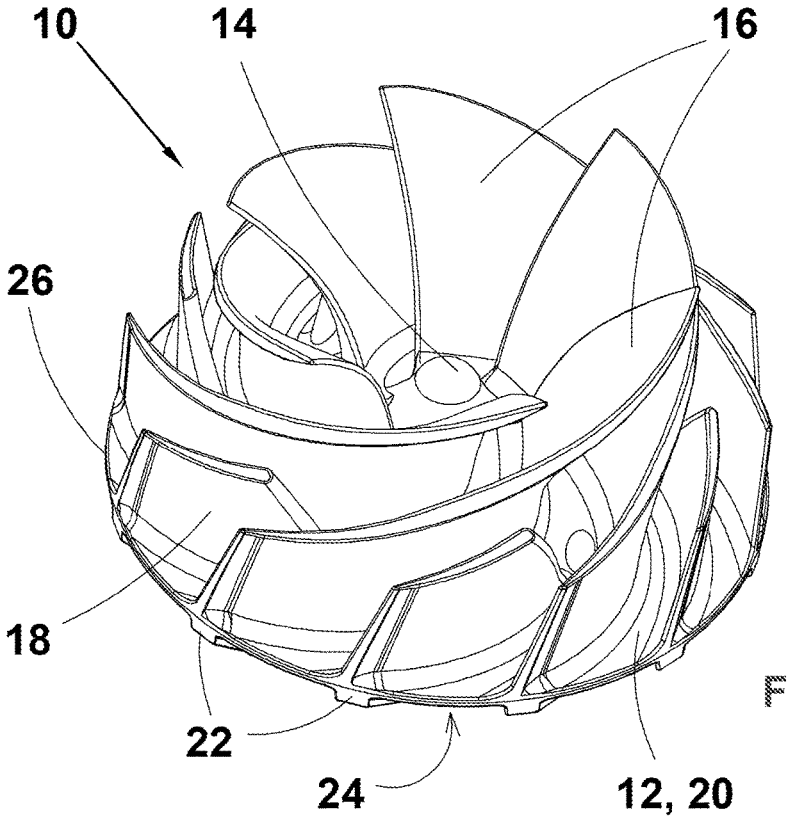
FIG. 1 illustrates a perspective view of the impeller in accordance with a first preferred embodiment of the present invention.
Figure 2:
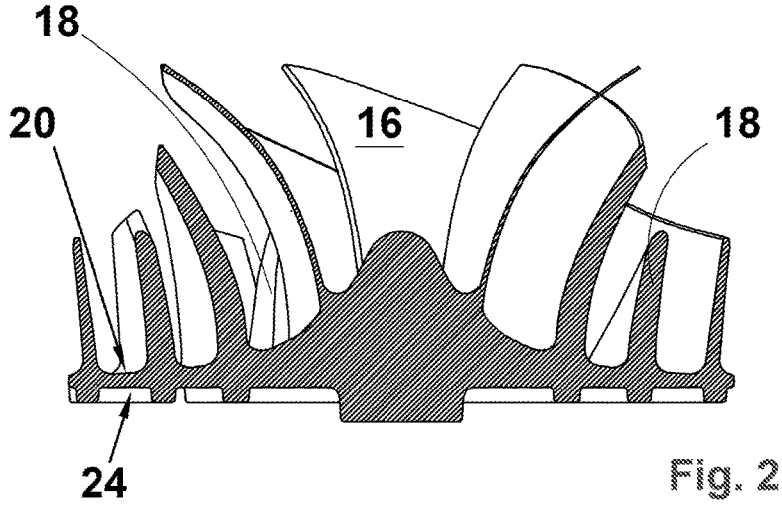
FIG. 2 illustrates schematically a cross-section of the impeller in accordance with the first preferred embodiment of the present invention along line A-A of FIG. 4.
Figure 4:
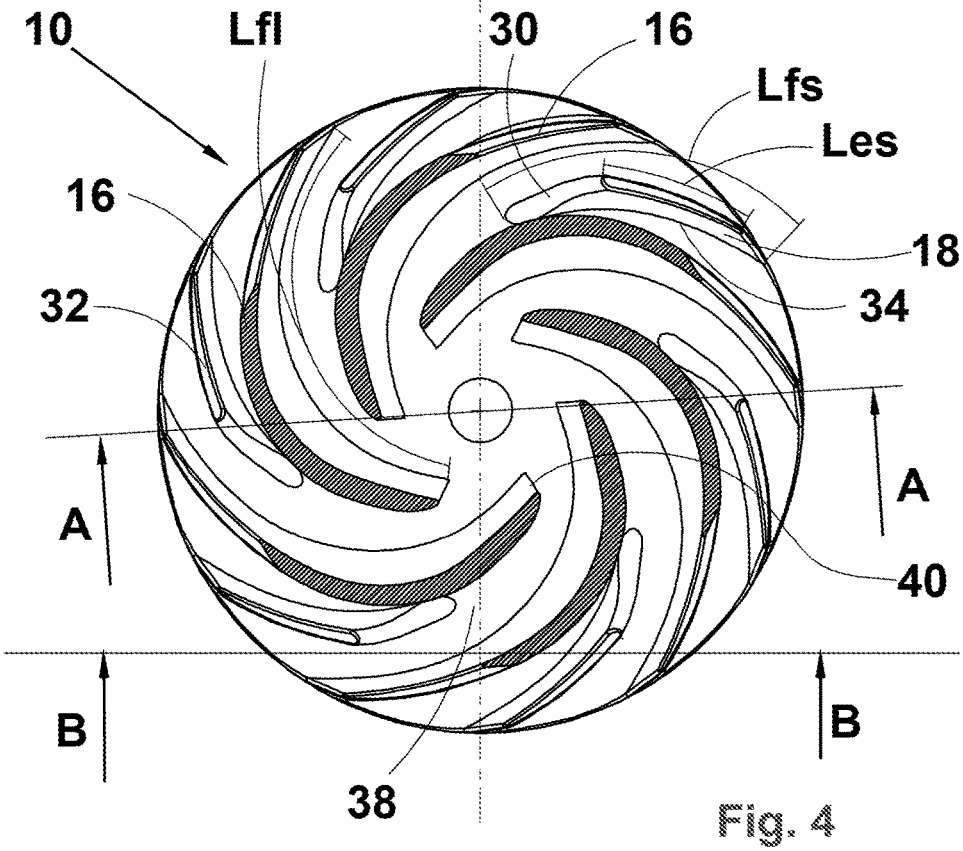
FIG. 4 illustrates schematically a partial cross-section of the impeller in accordance with the first preferred embodiment of the present invention along line C-C of FIG. 3.

FIG. 1 illustrates a perspective view and FIG. 2 a cross-sectional view along line A-A of FIG. 4 of the impeller in accordance with a preferred embodiment of the present invention. The impeller 10 is a semi-open impeller having a rear plate or shroud 12 with a hub 14 and longer working vanes 16 and at least one intermediate or shorter working vane 18 in each vane passage between the longer working vanes 16 at the front side of the shroud 12, i.e. at the face 20 of the shroud 12 facing the pump inlet (not shown). The shroud 12 preferably, but not necessarily includes rear vanes 22 at the rear face 24 of the shroud 12. In a further variation of the present invention the rear face 24 includes as many rear vanes 22 as there are working vanes 16 and 18 on the front face 20 of the shroud, the rear vanes 22 being positioned opposite the working vanes 16 and 18 and having, preferably but not necessarily, the same length as the working vanes 16 and 18. The shroud 12 has an outer circumference 26 up to which the working vanes 16 and 18, i.e. both longer and shorter ones, preferably, but not necessarily, extend. Naturally, also the rear vanes 22 extend to the outer circumference 26 in the manner of the working vanes 16 and 18. In a still further variation of the present invention a prerequisite for the optimal operation of the impeller of the invention is that both the longer working vanes and the shorter intermediate working vanes extend up to the same circumference and have the same vane shape and orientation at their outer edges. The longer working vanes 16 extend towards the inlet channel (not shown) of the pump housing such that the outer (in relation to the shroud 12) tips of the leading edges of the longer working vanes are at a small spacing from the annular borderline between the pump inlet channel and the pump volute. In other words, the outer tips of the leading edges of the longer working vanes 16 have substantially the same diameter as the inlet channel of the pump housing.

Figure 3:
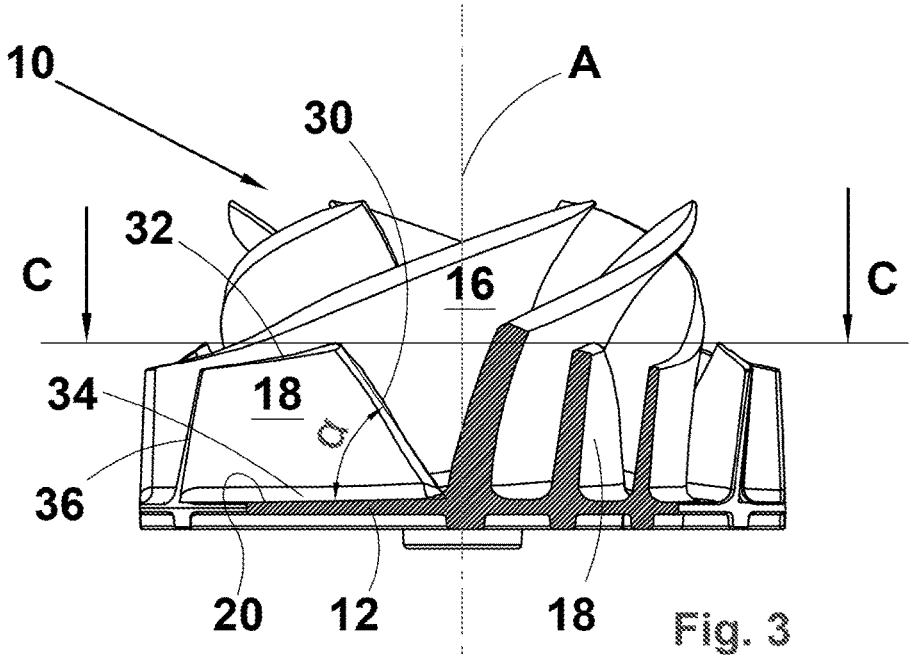
FIG. 3 illustrates schematically a partial cross-section of the impeller in accordance with the preferred embodiments of the present invention along line B-B of FIG. 4.

FIG. 3 illustrates schematically a partial cross-section of the impeller in accordance with preferred embodiments of the present invention, the cross-section being taken along line B-B of FIG. 4. FIG. 3 illustrates in more detail the shape of the intermediate or shorter working vane 18. In other words, the working vane 18 has a leading edge 30 (the edge of the working vane 18 closest to the axis A of the impeller 10, i.e. the edge of the intermediate or shorter working vane 18 receiving the fluid flow), a front edge 32 facing the front wall of the pump casing (not shown), i.e. the edge 32 of the working vane 18 opposite to the foot part 34 of the working vane where the working vane 18 joins to the front face 20 of the impeller shroud 12, and a trailing edge 36. The trailing edge 36 of the shorter intermediate working vanes 18 is of its dimensioning and orientation identical with the trailing edge of the longer working vanes 16. The front edge 32 of the shorter intermediate working vanes 18 is identical with the corresponding part of the front edge of the longer working vanes 16. Also, the angle of tilt (angle between the centreline plane of the working vane and the front face of the shroud in a plane running parallel with the axis A of the impeller via the point of cross section of the centreline plane and the front surface of the shroud and at right angles to the line drawn on the front surface of the shroud to the point of cross section of the centreline plane and the front surface of the shroud as a tangent of the centreline plane) of the shorter working vane is the same as that of the longer working vane for the entire length of the shorter working vane. In other words, even if the angle of tilt of the vanes may change along the length of the vanes, the angles of tilt of the shorter and longer vanes are equal in each particular radial position of measurement. Thus, the shorter intermediate working vanes 18 are, in all respects, identical to the longer working vanes 16 except for the fact that an inner part i.e. a part radially closer to the axis A thereof is missing. Here in FIG. 3, it has been shown, as a preferred embodiment of the present invention, that the leading edge 30 of the shorter intermediate working vane 18 is inclined, i.e. it forms a sharp angle $\alpha$ with the front face 20 of the shroud. The inclination angle $\alpha$ is between 45 and 70 degrees. The inclination angle $\alpha$ is an angle between the leading edge 30 of the shorter intermediate working vane 18 and an imaginary line drawn on the front face 20 of the shroud 12 and being a tangent to the centreline plane of the shorter intermediate working vane 18 at the point of intersection between the leading edge 30 and the front face 20 of the shroud 12. By inclining the leading edge 30 of the shorter intermediate working vane 18 the pressure wave created by the leading edge 30 is made to advance such that the direction of the pressure wave front (direction of, for instance, a single peak of a wave, being parallel with the leading edge 30 of the shorter intermediate working vane 18) is not parallel with the trailing edge 36 of the shorter intermediate working vane 18 but at an angle thereto. Now that such a wave front leaves the trailing edge 36 it enters the flow having a wave front based on the longer working vane 16. As the wave front direction of the longer working vanes 16 is based on the direction of the leading edges of the longer working vanes 16 (substantially perpendicular to both the flow of the fluid entering the vane passages and the front face 20 of the shroud 12), and, as the directions of the leading edges of the longer and shorter working vanes are clearly different (the difference in the directions being approximately 20 to 45 degrees), the two different wave fronts will be mixed together and thereby dampen one another.

FIG. 4 illustrates schematically a partial cross-section of the impeller in accordance with a first preferred embodiment of the present invention, the cross-section being taken along line C - C of FIG. 3. In other words, the tops of the longer working vanes 16 have been cut away so that the leading edges 30 of the shorter intermediate working vanes 18 may be seen. Especially FIG. 4, which shows the important dimensions of the working vanes 16 and 18. In other words, the foot length Lfs of the shorter intermediate working vane 18, the edge length Les thereof, and the foot length Lfl of the longer working vane 16. The foot length Lfs of the shorter intermediate working vane 18 is measured along the curved line formed in the intersection of the centreline plane of the intermediate working vane 18 and the front face 20 of the shroud 12. The edge length Les is measured along the curved line formed in the intersection of the centreline plane of the shorter intermediate working vane 18 and the front edge 32 of the working vane 18. The foot length Lfl of the longer working vane 16 is measured along the curved line formed in the intersection of the centreline plane of the longer working vane 16 and the front face 20 of the shroud 12. In accordance with a preferred embodiment of the present invention the foot length of the shorter intermediate working vane 18 Lfs=1.2*Les−3.0*Les, and the edge length Les=0.3*Lfl−0.5*Lfl.

Referring to the functional features of the working vanes, and especially to the wave fronts formed at the leading edge of the working vanes, it may be seen in FIG. 4 that the leading and trailing edges of the longer working vanes 16 are substantially, but not necessarily, parallel, taking into account the curved nature of the working vanes 16, whereas the corresponding directions of the shorter intermediate working vanes 18 differ significantly, just for accomplishing a clear difference between the wave front directions of the shorter and longer working vanes. The same may be stated also by saying that the directions of the leading edges (30 and 40) of the longer working vanes and those of the shorter intermediate working vanes are not the same, i.e. the angles of inclination thereof are not the same. The angle of inclination is, generally speaking, measured, as explained already earlier, i.e. the inclination angle is an angle between the leading edge (30 or 40) of a working vane (16 or 18) and an imaginary line drawn on the front face 20 of the shroud 12 and being a tangent to the centreline plane of the working vane (16 or 18) at the point of intersection between the leading edge (30 or 40) and the front face 20 of the shroud. The difference in the orientation or the direction or the angles of inclination of the leading edges is of the order of 20-45 degrees.

Another feature of the impeller worth mentioning is the different main function of the longer and shorter working vanes. The longer working vanes by extending to the inlet opening of the pump and being designed as shown in the drawings ensure a low required NPSH and high efficiency ratio, whereas the shorter intermediate working vanes increase the pulse frequency by moving pulses having possibly a higher amplitude outside the critical frequency range, and by fighting the secondary pulses created by the longer working vanes 16 by means of a wave front advancing in a direction different from that of the longer working vanes 16. The result is that there is no need for inclining the working vanes 16 and 18 as taught, for instance, by EP-B1-0515466.

Figure 5:
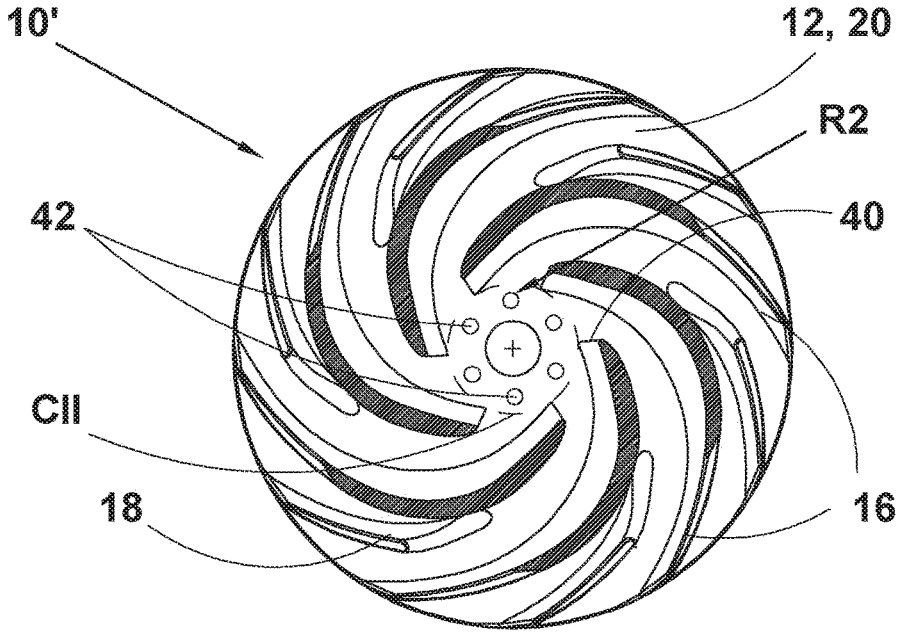
FIG. 5 illustrates schematically a partial cross-section of the impeller in accordance with a second preferred embodiment of the present invention along line C - C of FIG. 3.

FIG. 5 illustrates a partial cross-section of an impeller 10' in accordance with a second preferred embodiment of the present invention, the cross-section being taken along line C-C of FIG. 3. The second preferred embodiment comprises, in addition to the intermediate shorter working vanes 18 of the first embodiment, balance openings 42 extending through the shroud 12 and positioned in the shroud 12 inside the inner circumference Cll of the foot parts (at the intersection between the leading edge 40 of the longer working vanes 16 and the front face 20 of the shroud 12) of the leading edges 40 of the longer working vanes 16. The balancing openings or holes are needed, as, like it is well known in the art, when pumping liquid or a suspension by a centrifugal pump and thus increasing the pressure of the liquid in front of the impeller shroud, liquid is entrained into a space behind the impeller shroud of the centrifugal pump. The shaft sealing of the pump is then subjected to considerable pressure, whereby there is a clear risk of damaging the sealing. Therefore, by using balancing holes the pressure is allowed to escape from behind the impeller shroud to the front side of the shroud.

The pressure affecting the sealing may be reduced, even without using the balancing holes, by arranging rear vanes on the rear face of the shroud, the vanes creating a pressure preventing the liquid to be pumped from entering to the rear side of the shroud. The rear vanes are normally dimensioned so that they operate optimally only in a certain capacity range of the pump, whereby deviation in either direction from said capacity range results in that the pressure prevailing within the area of the rear vanes and also in the seal space changes. If the output of the pump is increased, the rear vanes generate, in the worst case scenario, a negative pressure, which can, at its worst, make the liquid in the seal space boil, especially when pumping liquids at a higher temperature. Correspondingly, when decreasing the capacity of the pump, for example, by constricting such by a valve, the pressure behind the impeller increases and the stresses increase. At the same time, naturally also the stress on the bearings increases.

In other words, also in cases where rear vanes are used, balancing holes are needed to balance the pressure conditions on the opposite sides of the impeller shroud.

Figure 6:
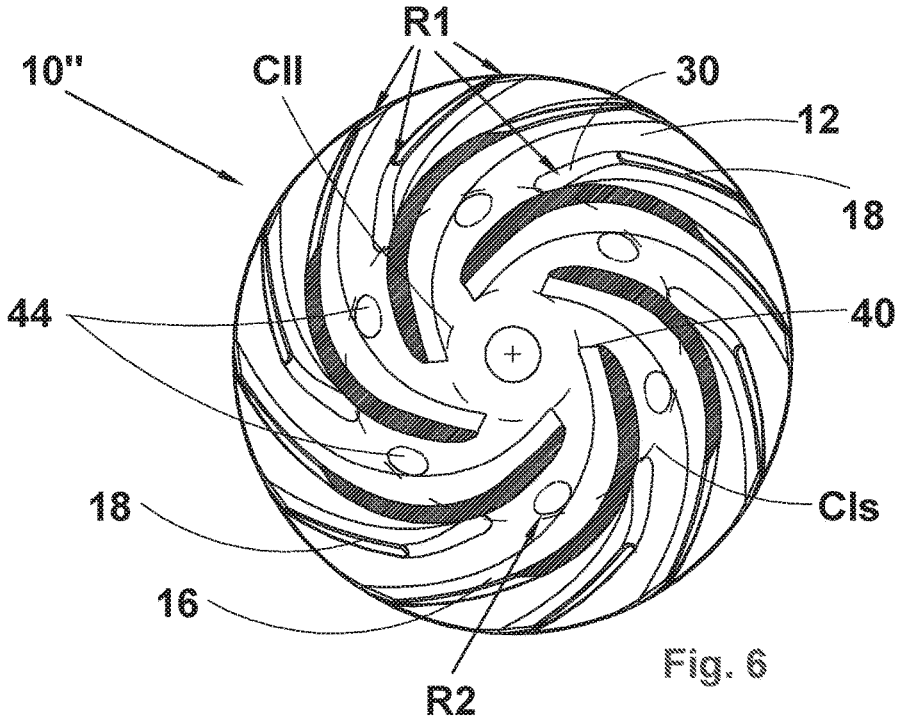
FIG. 6 illustrates schematically a partial cross-section of the impeller in accordance with a third preferred embodiment of the present invention along line C - C of FIG. 3.

FIG. 6 illustrates a partial cross-section of an impeller 10" in accordance with a third preferred embodiment of the present invention, the cross-section being taken along line C - C of FIG. 3. The third preferred embodiment comprises, in addition to the intermediate shorter working vanes 18 of the first embodiment, gas discharge openings 44 positioned in the shroud 12 between the longer working vanes 16 well outside the circumference Cll formed by the foot parts of the leading edges 40 of the longer working vanes 16. Simultaneously, the gas discharge openings 44 are within the circumference Cls formed by the foot parts of the leading edges 30 of the shorter intermediate working vanes 18, whereby the shorter intermediate working vanes 18 do not interfere the gas discharge. Additionally, the gas discharge openings 44 are positioned at the reduced pressure area behind the longer working vanes 16, i.e. close to the concave rear face of the longer working vane 16 to a position the separated gas collects first.

And finally, as a fourth preferred embodiment of the present invention may be mentioned an impeller construction, which has the shorter intermediate working vanes 18 of the first embodiment, the balancing openings 42 of the second embodiment and the gas discharge openings 44 of the third embodiment.

Earlier in the specification it was mentioned that the impeller may be provided with non-spinning means for preventing collection of fibres at the leading and trailing edges of the working vanes and at the balance and/or gas separation openings.

Figure 7:
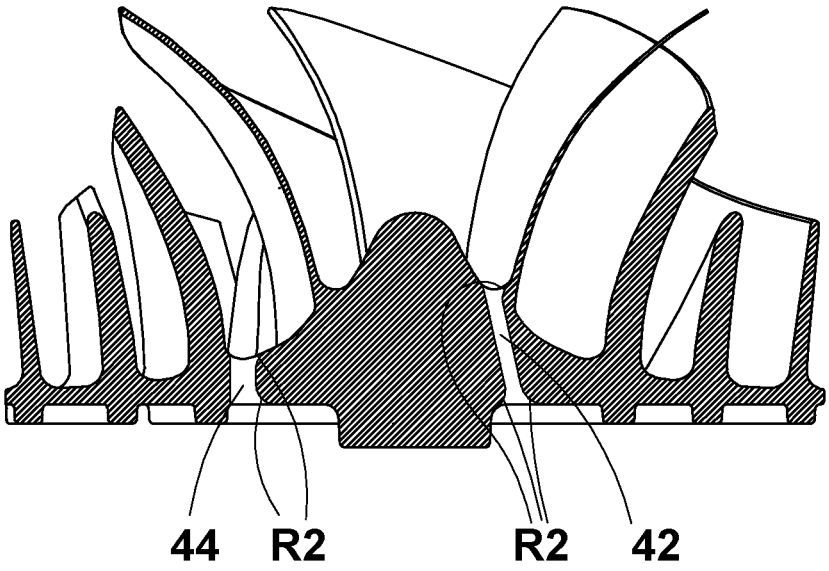
FIG. 7 illustrates schematically a partial cross-section of the impeller in accordance with a fourth embodiment of the present invention.

Such means at the leading and/or the trailing edges of the working vanes (both longer and shorter working vanes) may be a rounding R1 (FIG. 7) at the edges, the rounding having a radius preferably, but not necessarily, between ¼*S-½*S. By the thickness S of a working vane is, in this specification, generally understood the average Z-direction dimension of a working vane outside the rounded edge area. The non-spinning impeller vanes have been discussed in more detail in WO-A1-2015000677.

The openings, both balancing ones 42 (see FIG. 5) and gas separation ones 44, may preferably, but not necessarily, be provided with a corresponding rounding R2 (FIG. 7) at both their inlet and outlet. The rounding may, again be dimensioned to have a radius preferably, but not necessarily, between ¼*T-¼*T, where T is the thickness of the shroud at the opening.

As can be seen from the above description a novel centrifugal pump impeller construction has been developed. While the invention has been herein described by way of examples in connection with what are at present considered to be the preferred embodiments, it is to be understood that the invention is not limited to the disclosed embodiments, but is intended to cover various combinations and/or modifications of its features and other applications within the scope of the invention as defined in the appended claims.

The invention claimed is:

1. An impeller of a centrifugal headbox feed pump, the impeller comprising:

a shroud with a front face and a circumference;

a plurality of long working vanes on the front face; and a plurality of shorter intermediate working vanes on the front face between the long working vanes, the shorter intermediate working vanes having a leading edge and a foot part thereof, wherein the shorter intermediate working vanes have a leading edge with an angle of inclination, a foot length (Lfs) and an edge length (Les), the long working vanes having a leading edge with an angle of inclination, the angles of inclination of the leading edges of the long and shorter working vanes having a difference of 20 to 45 degrees, the foot length (Lfs) of the shorter intermediate working vane being between 1.2* Les and 3.0* Les and at least one of a plurality of openings for gas discharge arranged through the shroud within a circumference formed by the foot parts of the leading edges of the shorter intermediate working vanes and of a plurality of balancing openings arranged through the shroud within a circumference formed by the foot parts of the leading edges of the long working vanes.

2. The impeller as recited in claim 1, wherein the long working vanes have a foot length (Lfl), and the edge length (Les) of the shorter intermediate working vane being between 0.3* Lfl and 0.5* Lfl.

3. The impeller as recited in claim 1, wherein the angle inclination of the leading edge of the shorter intermediate working vanes is 45-70 degrees with the front face of the shroud.

4. The impeller as recited in claim 1, wherein a number of the shorter intermediate working vanes is the same or a multitude of a number of long working vanes.

5. The impeller as recited in claim 1, wherein intermediate shorter vanes divide a radially outer part of each vane passage between the long working vanes into two or more equally sized smaller vane passages.

6. The impeller as recited in claim 1, further comprising rear vanes arranged on a rear face of the shroud.

7. The impeller as recited in claim 6, wherein a number and length of the rear vanes correspond to those of the long and shorter working vanes on the front face of the shroud.

8. The impeller as recited in claim 6, wherein the rear vanes are positioned on the rear face of the shroud opposite the long and shorter working vanes on the front face of the shroud.

9. The impeller as recited in claim 6, wherein the long and shorter working vanes have an average thickness (S) and that the leading or the trailing edges of the working vanes are provided with a rounding (R1).

10. The impeller as recited in claim 9, wherein the rounding (R1) has a radius between ¼*S and ½*S.

11. The impeller as recited in claim 1, wherein the gas discharge openings are provided with a rounding (R2).

12. The impeller as recited in claim 11, wherein the shroud has a thickness (T) and the rounding (R2) has a radius between ¼*T and ½*T.

13. The impeller as recited in claim 1, wherein the balancing openings are provided with a rounding (R2).

14. The impeller as recited in claim 13, wherein the shroud has a thickness (T) and the rounding(R2) has a radius between ¼*T and ½*T.

15. A centrifugal headbox feed pump comprising the impeller of claim 1.

* * * * *